US006343414B1

(12) United States Patent
Nice et al.

(10) Patent No.: US 6,343,414 B1
(45) Date of Patent: Feb. 5, 2002

(54) SNAP-DISK FORMATION PROCESS AND MACHINE

(75) Inventors: Donald E. Nice, Morrison, IL (US); Richard T. Kidwell, Dothan, AL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/401,631

(22) Filed: Sep. 22, 1999

(51) Int. Cl.[7] ..... H01H 11/00
(52) U.S. Cl. ..... 29/622; 29/593
(58) Field of Search ..... 29/622, 592.1, 29/593, 701, 7.05, 711

(56) References Cited

U.S. PATENT DOCUMENTS

| | | | | | |
|---|---|---|---|---|---|
| 14,887 | A | | 5/1856 | Seymour | |
| 1,383,475 | A | | 7/1921 | McCabe | |
| 1,593,511 | A | | 7/1926 | Spencer | |
| 2,735,390 | A | | 2/1956 | Engel | |
| 2,913,008 | A | | 11/1959 | Cordero | |
| 3,375,694 | A | | 4/1968 | Pratt | |
| 3,720,090 | A | | 3/1973 | Halpert et al. | |
| 3,748,888 | A | | 7/1973 | Gerich | |
| 3,946,212 | A | | 3/1976 | Nakao et al. | |
| 4,099,408 | A | | 7/1978 | Ludwigson | |
| 4,317,354 | A | | 3/1982 | Wisebaker | |
| 4,548,066 | A | | 10/1985 | Martinez et al. | |
| 4,567,774 | A | | 2/1986 | Manahan et al. | |
| 4,693,109 | A | | 9/1987 | Connor et al. | |
| 4,750,131 | A | | 6/1988 | Martinez | |
| 4,853,504 | A | * | 8/1989 | Tanaka | 200/83 P |
| 4,855,545 | A | * | 8/1989 | Kreuter | 200/81.4 |
| 4,891,479 | A | * | 1/1990 | Davis | 200/81 R |
| 4,931,604 | A | * | 6/1990 | Poling | 200/406 |
| 4,939,231 | A | * | 7/1990 | Tanaka | 200/83 P |
| 4,947,544 | A | * | 8/1990 | Iwakiri | 29/622 |
| 4,948,931 | A | * | 8/1990 | Nixon | 200/83 |
| 4,967,047 | A | * | 10/1990 | Betterton | 200/83 J |
| 4,990,728 | A | * | 2/1991 | Joyce | 200/83 |
| 4,998,087 | A | * | 3/1991 | Boulanger | 337/354 |
| 5,001,317 | A | * | 3/1991 | Atkinson | 200/834 |
| 5,004,873 | A | * | 4/1991 | Schnut | 200/83 |
| 5,015,808 | A | * | 5/1991 | Czarn | 200/83 |
| 5,049,708 | A | * | 9/1991 | Baker | 200/83 |
| 5,196,997 | A | | 3/1993 | Kurtzberg et al. | |
| 5,198,631 | A | * | 3/1993 | Hogue | 200/83 |
| 5,301,118 | A | | 4/1994 | Heck et al. | |
| 5,311,759 | A | | 5/1994 | Mangrulkar et al. | |
| 5,379,227 | A | | 1/1995 | Tang et al. | |
| 5,390,127 | A | | 2/1995 | Tang et al. | |
| 5,423,199 | A | | 6/1995 | Magrulkar | |
| 5,440,478 | A | | 8/1995 | Fisher et al. | |
| 5,471,823 | A | | 12/1995 | Carroll et al. | |
| 5,582,059 | A | | 12/1996 | Schubert | |
| 5,586,041 | A | | 12/1996 | Mangrulkar | |
| 5,715,180 | A | | 2/1998 | Hu | |
| 5,717,607 | A | | 2/1998 | Hu | |
| 5,751,582 | A | | 5/1998 | Saxena et al. | |
| 5,841,676 | A | | 11/1998 | Ali et al. | |

* cited by examiner

*Primary Examiner*—Lee Young
*Assistant Examiner*—Sean Smith
(74) *Attorney, Agent, or Firm*—Armstrong Teasdale LLP

(57) ABSTRACT

A snap-disk formation assembly and method provides feedback control of a snap-disk form station in communication with an exercise station and coupled to a feedback station. A disk blank is inserted into a pocket and loaded into a dial fixture which travels along a communication axis between the form station, the exercise station, and the feedback station. The pocket holds the metal disk while a snap-disk reset side and a trip side are formed and exercised. A feedback station determines actual snap forces for one or both sides of the disk and provides feedback control to the form station to bring successively formed disks within desired manufacturing tolerances.

16 Claims, 6 Drawing Sheets

SNAP-DISK FORMATION PROCESS AND MACHINE

BACKGROUND OF THE INVENTION

This invention relates generally to formation machines and processes and, more particularly, to a process and machine for forming bistable snap-disks.

Bistable snap-disks are typically utilized as mechanical cycling components in fluid operated switching devices, pressure cycling devices, and other mechanisms utilizing a two-position, bistable, snap-action switch. See, for example, U.S. Pat. No. 5,198,631. Such snap-disks include a convex configuration and a concave configuration to engage or disengage electrical contacts and open and close an electrical circuit, respectively. The snap-disks snap, or "trip" between a convex and concave configuration depending on the application of sufficient external forces on one of the sides of the disk, such as, for example, a pressure, and snap or "reset" into an original configuration when those external forces fall below a predetermined value. The required forces causing a snap-disk to trip or reset between the convex and concave configurations, and vice-versa, vary from application to application, but for a given disk, the trip and reset force values are usually unequal.

Bimetallic and monometallic snap-disks are typically formed with a full radius punch that forms a curved shape in the central portion of the disk. Precise formation tolerances are required in forming snap-disks so that the disks adequately react to external forces, such as temperature or pressure differentials, in a given switch application. The precise formation tolerances, however, are difficult to consistently achieve using current snap-disk formation methods. Consequently, a one hundred percent sort of formed snap-disks is often required, and yields of acceptable snap-disks upon initial formation are as low as thirty percent. The low yield of acceptable disks decreases manufacturing efficiency and raises the costs of production of the snap-disks.

Accordingly, it would be desirable to increase the yield of acceptable snap-disks upon initial formation and decrease production costs in snap-disc formation.

BRIEF SUMMARY OF THE INVENTION

In an exemplary embodiment of the invention, a snap-disk form assembly and method includes a form station coupled to a feedback station so that the formation of the snap-disks may be monitored in real time as the snap-disks are formed. Thus, correction of any deficiency in the formation process is detected and redressed nearly instantaneously.

More particularly, the form station includes a plurality of cams, with each cam including a respective tool. The plurality of cams and tools in the form station stretch the sides of disk blanks to plastic deformation and thereby form the reset and trip sides of the disk.

The feedback station includes a cam-driven probe that sequentially monitors the required peak force to snap the form disks into a respective alternative configuration after they are formed, and monitors the required peak reset force to snap the form disks into their original configuration. A force transducer is connected to the probe, and the probe is brought into engagement with one of the sides of the snap-disks. Therefore, the probe applies a force to the snap-disk that is measured by the force transducer and used for feedback control of the form station. Force is applied by the probe until the disk trips, and the measured peak force that caused the disk to trip is recorded by a feedback station controller. The force applied by the probe is then decreased until the disk resets into its original configuration, and the peak force before the disk resets is also recorded by feedback station controller.

A mean peak trip force value and a mean rest trip force value are calculated for a predetermined number of disks, and the mean values are compared to a predetermined trip target value and a reset target value, respectively. The operation of the tools in the form station are then adjusted in real time, based upon the comparison of the measured mean value to the target value, to change the required peak snap force of successively formed disks and bring successive disks within desired peak snap force tolerances.

Using statistical process control feedback from the feedback station to adjust formation parameters in the form station increases the initial pass rate of the snap-disks and lowers the costs of snap-disk production.

DETAILED DESCRIPTION OF THE INVENTION

Figure 1:
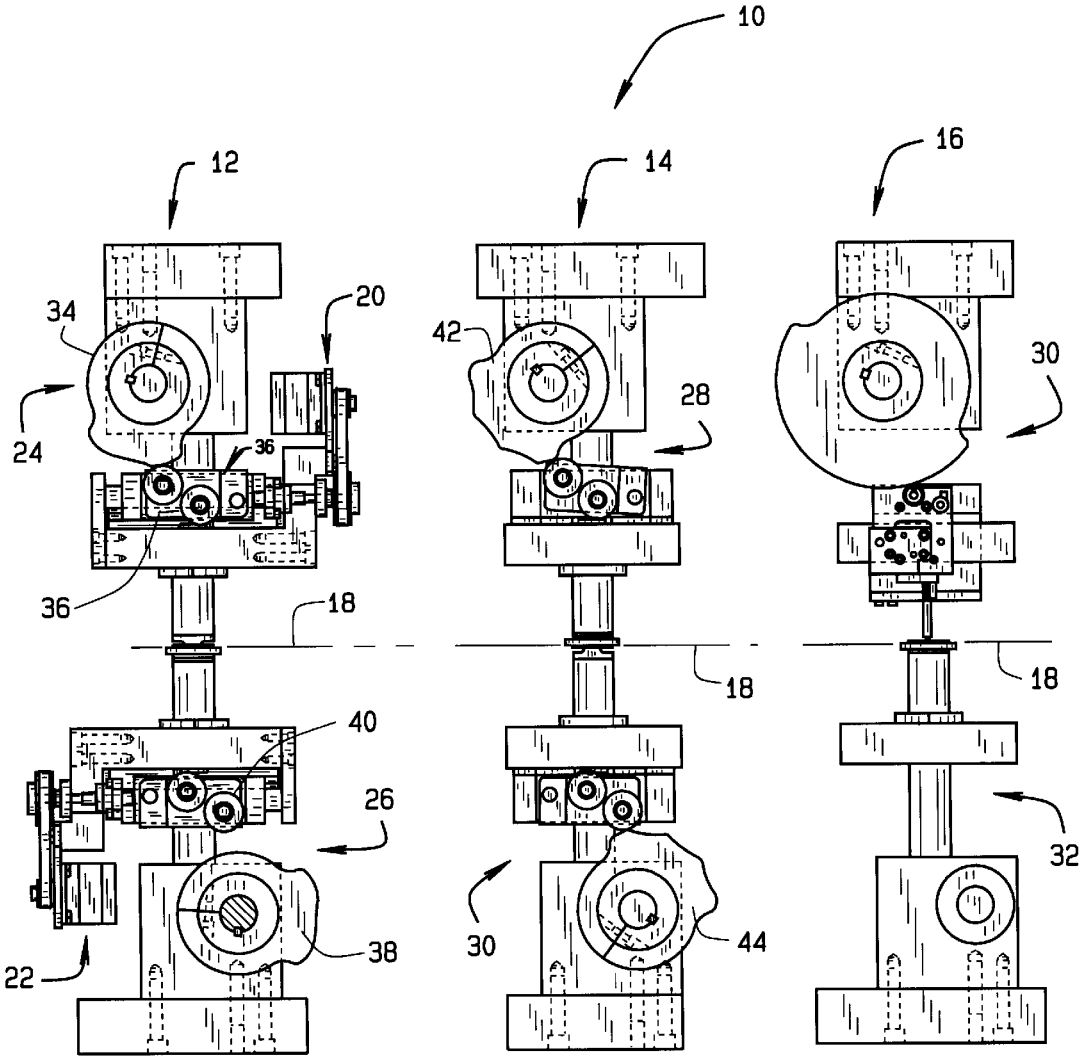
FIG. 1 is a schematic view of a snap-disk form assembly including a form station, an exercise station, and a feedback station.

FIG. 1 schematically illustrates a snap-disk formation assembly 10 including a form station 12, an exercise station 14, and a feedback station 16 aligned along a communication axis 18. Flat metallic or nonmetallic disk blanks (not shown) are positioned in pockets (not shown) in dial fixtures (not shown) and are translated from form station 12, to exercise station 14, and to feedback station 16 along communication axis 18. Form station 12 provides the disk blanks with a convex and concave configuration on each side of the disk, respectively, with probing action punches (not shown in FIG. 1) that stretch the disk to plastic deformation, thereby forming the reset and trip sides of the bistable disks. Exercise station 14 repeatedly subjects the reset and trip sides of the disk to predetermined forces, respectively, to exercise the snap action of the newly formed bistable snap-disks.

Feedback station 16 includes a force transducer (not shown in FIG. 1) and controls (not shown) that are used to determine the actual force required to trip or reset each snap-disk in a batch of formed and exercised snap-disks. The trip and/or reset forces are recorded for each snap-disk, and the results are analyzed by comparing them to target values. Based on the differential between actual trip and/or reset values for each snap-disk, statistical process feedback control is used to adjust the probing action of form station 12 with a reset stepper motor 20 (further described below) and a trip stepper motor 22 (also described below) to vary the forces used to form the reset and trip sides of the snap-disks, respectively.

Form station 12 comprises a reset portion 24 and a trip portion 26 separated by communication axis 18. Exercise station 14 includes a reset portion 28 and a trip portion 30 separated by communication axis 18, and feedback station 16 includes a reset portion 30 and a trip portion 32 separated by communication axis 18. Form station 12 and exercise station 14 are substantially inversely symmetrical about communication axis 18. In other words, the trip portions 26, 30 of form and exercise stations 12, 14 are generally mirror images of reset portions 24, 28 of form and reset stations 12, 14, respectively, about communication axis 18, but rotated 180 so that trip portions 26, 30 are reversed from side-to-side relative to reset portions 24, 28.

In operation, flat disk blanks of snap-disk material are individually loaded into pockets in the dial fixtures before reaching form station 12. A concave configuration is formed into a reset side of the snap-disk using a reciprocating reset form punch (not shown in FIG. 1) that is actuated by a reset form cam 34 and a reset form cam follower 36 and stretches the reset side of the disk into plastic deformation. Once the reset side of a snap-disk is formed, a convex configuration is formed into a trip side of the disk using a reciprocating trip form punch (not shown in FIG. 1) that is actuated by a trip form cam 38 and a trip cam follower 40 and stretches the trip side of the disk into plastic deformation. Reset form cam 34 and trip form cam 38 are rotationally out-of-phase with one another to avoid interference of the reset and trip punches during formation of the snap-disks.

Each snap-disk is then indexed, while in the pocket, along communication axis 18 to exercise station 14. The reset side and the trip side of the snap-disk are then repeatedly subjected to a predetermined reset exercise force, a predetermined trip exercise force, or beyond, through actuation of a reset exercise punch (not shown) by a reset exercise cam 42 and actuation of a trip exercise punch (not shown) by a trip exercise cam 44, respectively, to exercise the snap action of the snap-disk.

Once exercised appropriately, each snap-disk is indexed along communication axis 18 to feedback station 16 that includes a reset and/or a trip force transducer (not shown in FIG. 1) that determines the actual required force to cause each snap-disk to snap between the convex and concave configurations. The reset force and/or trip forces are recorded, analyzed, and compared to target reset force values and trip force values. Using feedback control to stepper motors 20, 22, adjustments can be made in the applied force of the reset form punch and the reset trip punch to bring successively formed snap-discs within a desired reset force and trip force tolerance.

Snap disks are then indexed out of feedback station 16 and placed into one of three storage bins including a discard bin (not shown), a reform bin (not shown), or an acceptable pass bin (not shown). Thus, snap-disks are sorted based upon the measured values of the reset force and trip force for the disks. By providing instantaneous feedback to form station reset stepper motor 20 and trip stepper motor 22 to adjust the formation process while it is occurring, the yield of acceptable snap-disks upon initial formation of the disks can be improved dramatically.

Figure 2:
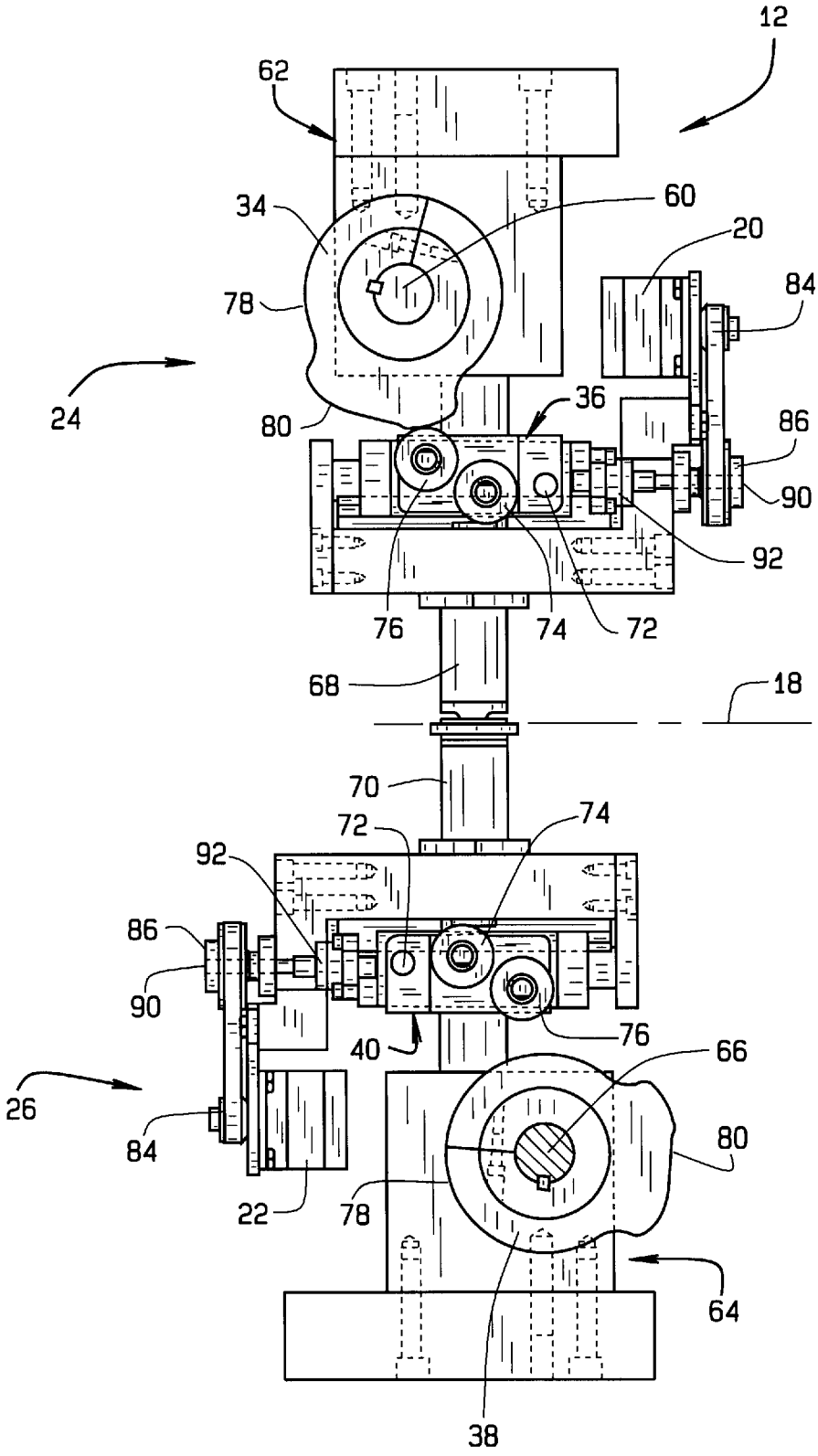
FIG. 2 is a front plan view of the form station shown in FIG. 1.

FIG. 2 is a front plan view of form station 12, including reset portion 24 and trip portion 26. Reset form cam 34 is attached to a reset form cam shaft 60 that is rotationally driven by a reset drive shaft assembly 62. Reset form drive shaft assembly 62 communicates with a trip form shaft assembly 64 via a belt (not shown) and therefore drives a trip cam shaft 66 attached to trip form cam 38. Reset cam follower 36 contacts reset form cam 34 to reciprocally move a reset form punch (not shown in FIG. 2) trip form cam follower 40 contacts trip form cam 38 to reciprocally move a trip form punch (not shown in FIG. 2) inside a respective reset form tool housing 68 and trip form tool housing 70.

Reset and trip form cam followers 36, 40 each include a pivot pin 72, a form bearing 74, and a cam follower bearing 76. Each cam follower bearing 76 contacts a respective cam surface 78 of reset form cam 34 and trip form cam 38. Each cam surface 78 is configured with a raised portion 80 that engages cam follower bearing 76 and causes the respective cam follower 36, 40 to pivot about pivot pin 72. As each cam follower 36, 40 pivots, a respective form bearing 74 moves toward and away from communication axis 18. Each form bearing 74 engages a respective reset form punch (not shown) or trip form punch (not shown) to engage or disengage the punch from a disk of snap-disk material.

Reset and trip stepper motors 20, 22, respectively, each include a driver adjust pulley 84, a driven adjust pulley 86 and a timing belt 88 connecting driver adjust pulley 84 and driven adjust pulley 86. Each driven adjust pulley 86 engages a lead screw 90 which varies the lateral position of a form stroke adjust slide 92 connected to each of reset form cam follower 36 and trip form cam follower 40. Thus, reset stepper motor 20 and trip stepper motor 22 are used to turn lead screws 90 and adjust the position of reset form cam follower 36 and trip form cam follower 40, respectively, relative to reset form cam 34 and trip form cam 38. The magnitude of the pivoting movement of reset cam follower 36 and trip cam follower 40, and hence the movement of form bearings 74, increases as the respective cam follower bearings 76 are positioned closer to reset form cam 34 and trip form cam 38. As the force applied to the snap-disks is directly related to the distance traveled by form bearings 74, stepper motors 20, 22 can be used to adjust the applied force in form station 12 to improve the acceptable pass yield of snap-disks upon initial formation. Each stepper motor 20, 22 provides two hundred stop points per revolution to reset form portion 24 and trip form portion 26, thereby allowing very fine incremental adjustments in position of cam followers 36, 40, and hence allowing very fine incremental adjustments in applied force to the snap-disks.

Figure 3:
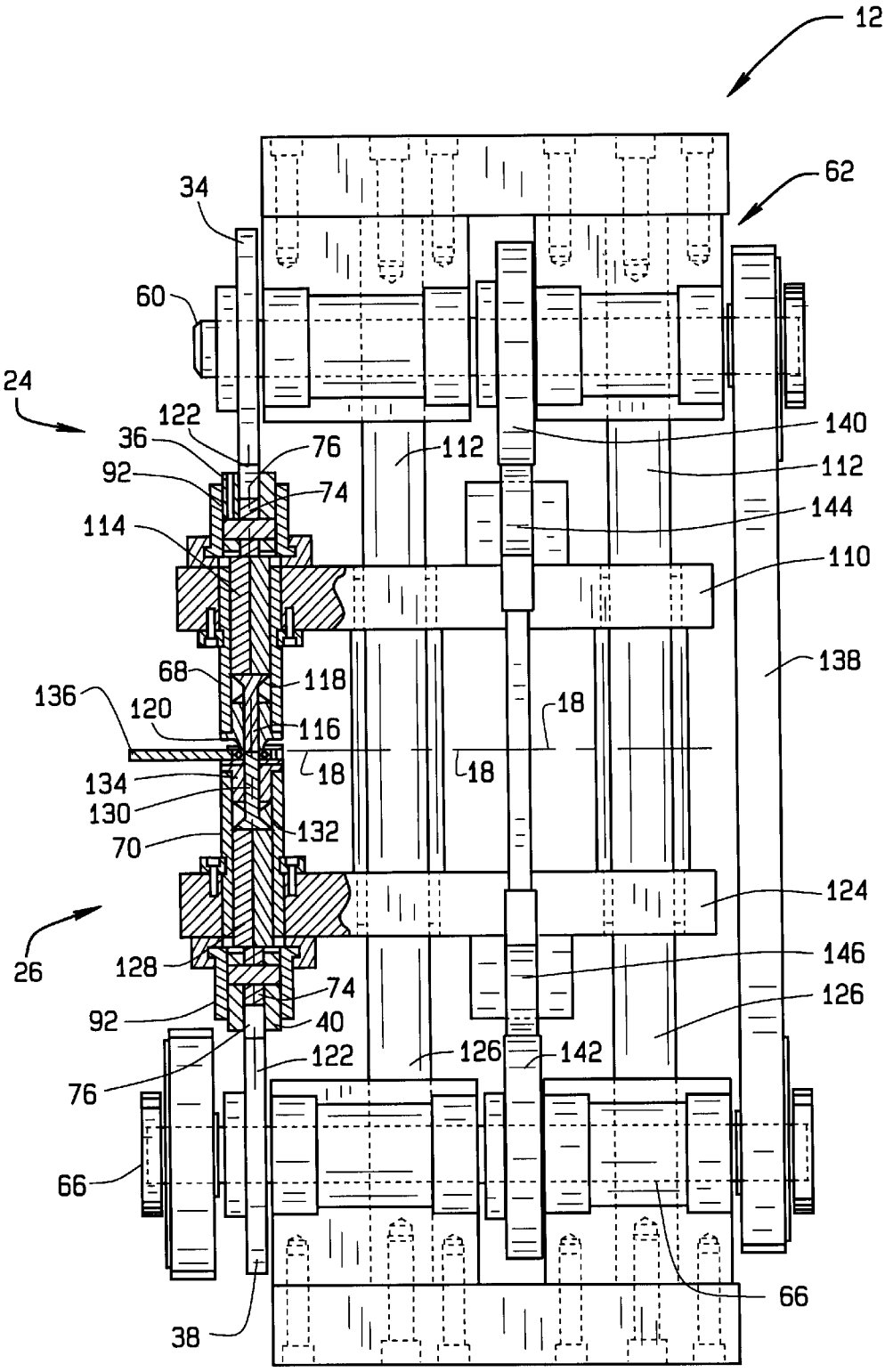
FIG. 3 is a partial cross-sectional view and side plan view of the form station shown in FIG. 2.

FIG. 3 is a partial cross-sectional view and side plan view of form station 12 including a spring loaded reset form tooling plate 110 slidingly mounted on cylinders 112 for reciprocating movement toward and away from communication axis 18. Reset tool housing 68 is connected to reset form tooling plate 110, and includes a spacer 114 communicating with form bearing 74 of reset cam follower 36 to actuate reset form punch 116 against the bias of a return spring 118. A nose tool 120 surrounds reset form punch 116 to guide reset form punch 116 along an actuation axis 122.

Trip form portion 26 includes a trip form tooling plate 124 slidingly mounted on cylinders 126 for reciprocating movement toward and away from communication axis 18. Trip tool housing 70 is connected to trip form tooling plate 124, and includes a spacer 128 communicating with form bearing 74 of trip cam follower 40 to actuate trip form punch 130 against the bias of a return spring 132. A form support 134 surrounds trip form punch 130 and guides trip form punch 130 along actuation axis 122.

A dial fixture 136 is supported by form support 134 and is aligned with communication axis 18. A pocket (not shown) in dial fixture 136 supports a circumference of a disk blank of snap-disk material (not shown) that is inserted into dial fixture 136 and positioned so that the center of the disk blank is substantially aligned with actuation axis 122. Reset form punch 116 and trip form punch 130 are positioned a first distance from the disk and a second distance from the disk, respectively, to form the reset and trip sides of the snap-disk with respective forces.

Reset drive shaft assembly 62 rotates reset cam shaft 60 on reset form portion 24, and a belt 138 transfers rotational motion of reset cam shaft 60 to trip cam shaft 66. Thus, as reset cam shaft 60 is rotated, a form main cam 140 synchronously rotates with reset form cam 34 to provide a probing action of reset form punch 116 into a blank disk of snap-disk material, and a trip main cam 142 synchronously rotates with trip form cam 38 to provide a probing action of trip form punch 130 into the disk blank. As shown in FIG. 2, cam surface raised portions 80 of reset form cam 34 and trip form cam 38 are rotationally out-of-phase with one another so that the reset probing action and trip probing action are performed sequentially and do not interfere with one another.

Once a disk of snap-disk material is properly aligned with actuation axis 122 within dial fixture 136, reset form cam 34 is rotated into engagement with reset form follower bearing 76, causing reset cam follower 36 to pivot about pivot pin 72 (shown in FIG. 2). As reset form cam follower 36 pivots, reset form bearing 74 pushes spacer 114 and form punch 116 toward communication axis 18. Also, form main cam 140 engages a form tooling plate bearing 144 and moves reset form tooling plate 110 toward communication axis 18. Reset form punch 116 is therefore engaged with the reset side of the disk blank, stretching the disk material into plastic deformation and forming the reset side of a snap-disk. The distance traveled by reset form punch 116 is adjustable by moving reset form portion 24 form adjust slide 92 with reset stepper motor 20 (shown in FIG. 2). The position of reset form adjust slide 92 determines the position of cam follower bearing 76 of reset cam follower 36 relative to reset form cam 34. Hence, the degree of pivoting of reset cam follower 36 is adjustable by adjusting the position of reset form adjust slide 92, which, in turn, varies the distance that form bearing 74 moves form punch 116, and consequently varies the forces developed in the disk by reset form punch 116.

As reset cam shaft 60 continues to rotate, form bearing 74 of reset cam follower 36 and main cam form tooling plate bearing 144 are disengaged from the respective cam surface raised portions of reset form cam 38 and form main cam 140, and the spring loaded reset form tooling plate 110 and form punch 116 are returned to a position wherein reset form punch 116 does not contact the snap disk and sufficient clearance is provided to allow formation of the trip side of the disk.

Once form bearing 74 of reset cam follower 36 is disengaged from reset form cam 38, trip form cam 34 raised surface portion 80 (shown in FIG. 2) engages cam follower bearing 76 of trip form cam follower 36 and causes trip form cam follower 36 to pivot about pivot pin 72 (shown in FIG. 2). As trip form cam 34 raised surface portion 80 pivots trip cam follower 40, trip form bearing 74 pushes spacer 128 and trip form punch 130 toward communication axis 18. Also, trip form main cam 142 engages a trip form tooling plate bearing 146 and moves trip form tooling plate 124 toward communication axis 18. Trip punch 130 is therefore engaged with the trip side of the disk blank, stretching the disk material into plastic deformation and forming the trip side of a snap-disk. The distance traveled by trip form punch 130 is adjustable by moving trip form portion 26 form adjust slide 92 with trip stepper motor 22. The position of trip form adjust slide 92 determines the position of cam follower bearing 76 of trip form cam follower 40 relative to trip form cam 38. Hence, the degree of pivoting of trip form cam follower 40 is adjustable by moving trip form adjust slide 92, which, in turn, varies the distance that form bearing 74 of trip form cam follower 40 moves trip form punch 130, and consequently varies the forces developed in the disk by trip form punch 130.

As trip cam shaft 66 continues to rotate, form bearing 74 of trip form cam follower 40 and trip form tooling plate bearing 146 are disengaged from the respective cam surface raised portions of trip form cam 38 and trip main form cam 140, and the spring loaded trip tooling plate 124 and trip form punch 130 are returned to a position wherein trip form punch 130 does not contact the snap disk. The formation process in form station 12 may then be repeated or the dial fixture may be indexed to exercise station 14 (shown in FIG. 1).

Figure 4:
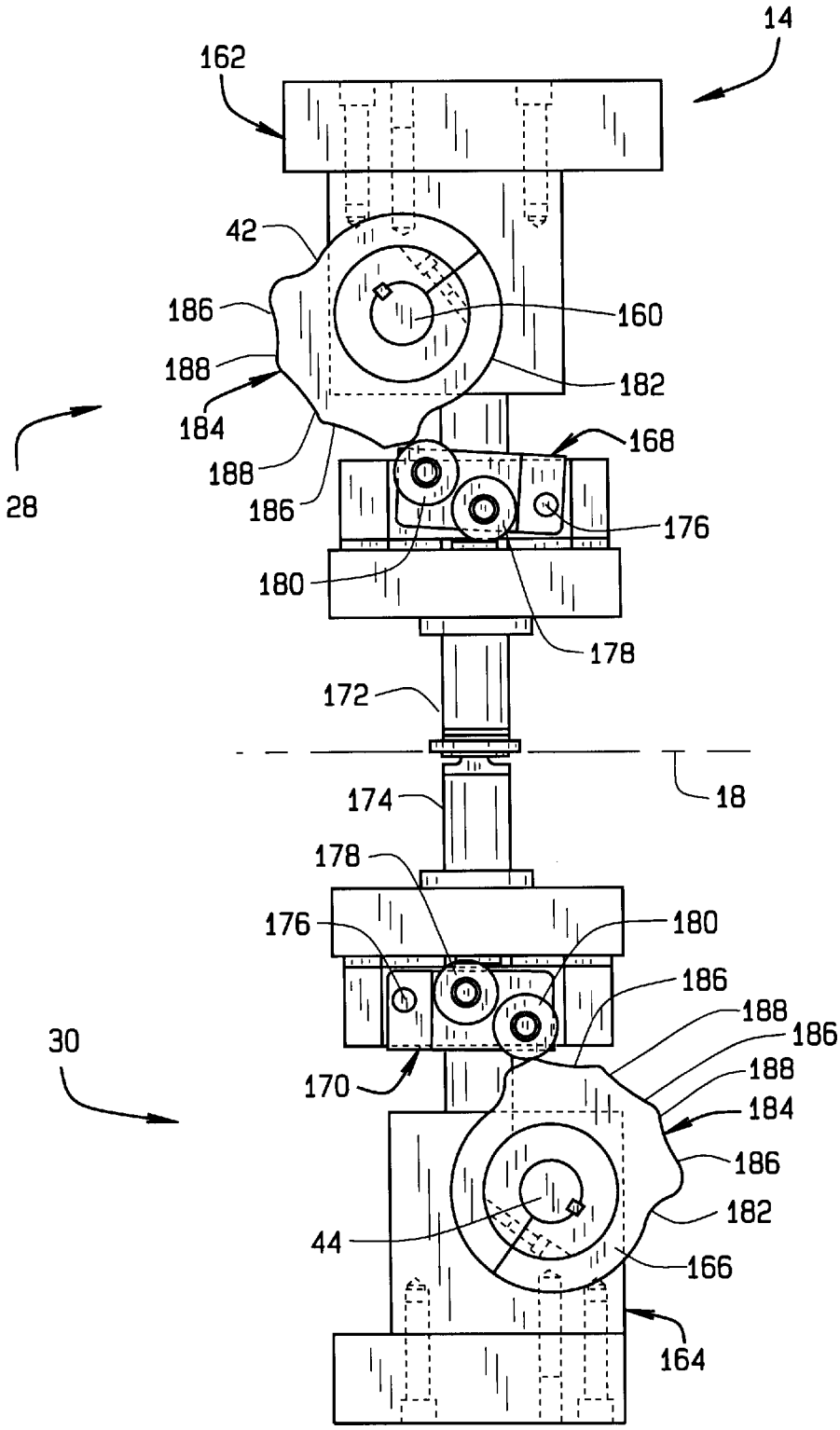
FIG. 4 is a front plan view of the exercise station shown in FIG. 1.

FIG. 4 is front plan view of exercise station 14, including reset portion 28 and trip portion 30 similar in structure and operation to form station 12, but without the adjustability of stepper motors 20, 22 (shown in FIGS. 1 and 2) and with different cam surface configurations. Reset exercise cam 42 is attached to a reset exercise cam shaft 160 that is rotationally driven by an exercise drive shaft assembly 162. Reset exercise drive shaft assembly 162 communicates with a trip exercise shaft assembly 164 via a belt (not shown) and therefore drives a trip exercise cam shaft 166 attached to trip exercise cam 44. An exercise reset cam follower 168 contacts reset exercise cam 42 to reciprocally move a reset exercise punch (not shown in FIG. 2) and an exercise trip cam follower 170 contacts trip exercise cam 44 to reciprocally move a trip exercise punch (not shown in FIG. 2) inside a respective reset exercise tool housing 172 and trip exercise tool housing 174, respectively.

Exercise reset and trip form cam followers 168, 170 each include a pivot pin 176, a form bearing 178, and a cam follower bearing 180. Each cam follower bearing 180 contacts a respective cam surface 182 of reset exercise cam 42 and trip exercise cam 44. Each cam surface 182 is configured with a raised portion 184 that engages cam follower bearing 180 and causes each respective cam follower 168, 170 to pivot about pivot pin 176. More specifically, each cam surface raised portion 184 includes a rising profile 186 and a falling profile 188 that produces a pulsating reset force or pulsating trip force for exercising snap disks. As each cam follower 168, 170 pivots, a respective form bearing 178 moves toward and away from communication axis 18. Form bearings 178 engage a respective reset or trip exercise punch (not shown) to engage or disengage the respective punch from a snap-disk, as substantially described above with respect to FIG. 3. Once formed snap disks have been sufficiently exercised, the snap disks are indexed to feedback station 16 (shown in FIG. 1).

Figure 5:
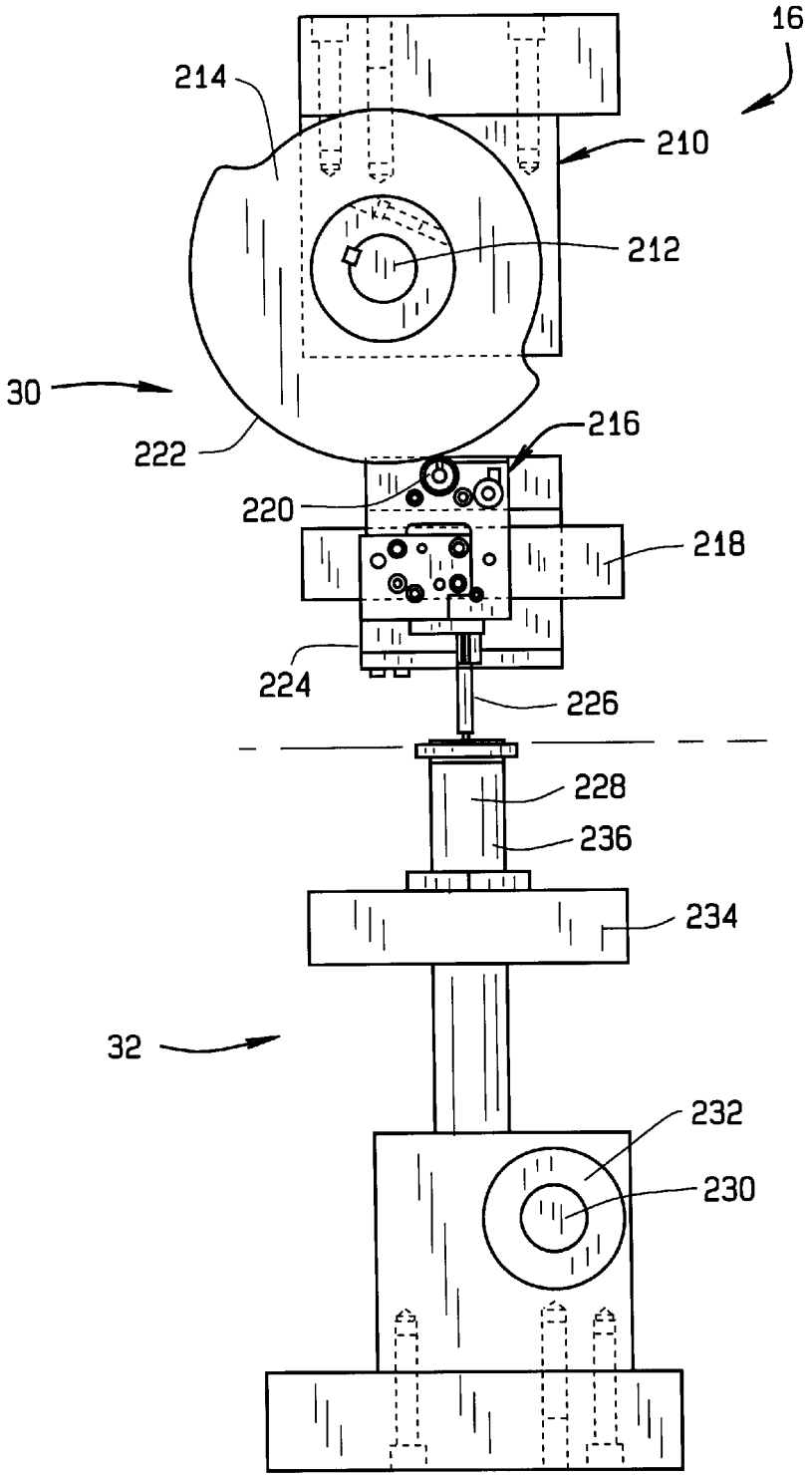
FIG. 5 is a front plan view of the feedback station shown in FIG. 1.

FIG. 5 is a front plan view of feedback station 16 including a reset portion 30 and a trip portion 32. Reset portion 30 includes a feedback drive assembly 210 for driving a reset cam shaft 212 and an attached feedback cam 214. A feedback cam follower 216 is attached to a spring-loaded feedback tooling plate 218 and includes a feedback follower bearing 220 that contacts a cam surface 222 of feedback cam 214, and a force transducer unit 224. A probe 226 extends from force transducer unit 214 along a probe axis 228.

Feedback trip portion 32 includes a trip feedback shaft 230 and an attached hub 232 that are rotationally driven by feedback drive assembly 210 and a belt (not shown in FIG. 5). A spring loaded trip feedback tooling plate 234 supports a feedback support 236 that facilitates force measurement with probe 226.

Figure 6:
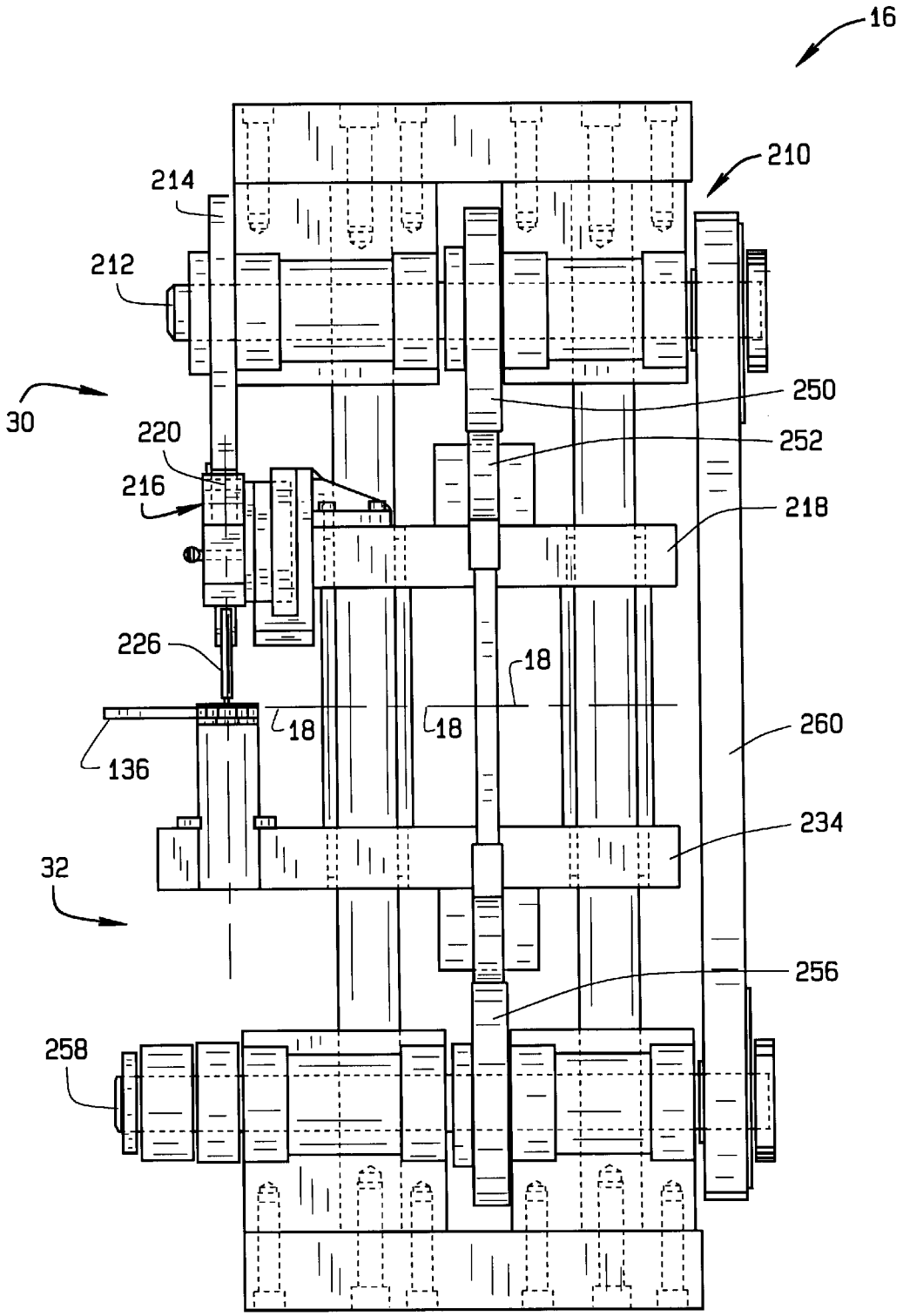
FIG. 6 is a partial cross-sectional view and side plan view of the feedback station shown in FIG. 5.

FIG. 6 is a side plan view of feedback station 16, illustrating a feedback reset main cam 250 that is attached to reset cam shaft 212 and rotates synchronously with feedback cam 214. Feedback main cam 214 engages a feedback form bearing 252 and reciprocally moves feedback reset tooling plate 218 toward and away from communication axis 18. Feedback cam 214 contacts a cam follower bearing 220 of feedback cam follower 216 and moves probe 226 toward and away from communication axis 18. A feedback trip main cam 256 is attached to a feedback trip shaft 258 and driven by feedback drive assembly 210 and belt 260 to move feedback trip tooling plate 234 relative to communication axis 18. In one embodiment, feedback trip main cam 256 is circular so that feedback trip tooling plate 234 does not move relative to communication axis 18.

Dial fixture 136 is indexed to feedback station 16 with a formed and exercised snap-disk contained therein. Feedback reset main cam 250 and feedback cam 214 engage respective cam form bearings 220, 252 and move reset feedback tooling plate 254 and probe 226 closer to communication axis 18. Probe 226 contacts reset side of the snap-disk and exerts force against it as probe 226 is moved toward communication axis 18 until the snap-disk snaps or trips into its alternative configuration. The peak force that caused the disk to trip is electronically recorded for each disk passing through feedback station 16, and a mean or average peak trip force is calculated over a specified number of disks, such as, for example, five disks. As feedback cam 214 continues to rotate, the applied force of probe 226 decreases, and the disk eventually resets. A peak reset force is also electronically recorded for each disk passing through feedback station 16, and a mean or average peak reset force is calculated over a specified number of disks.

Using a controller (not shown), the mean trip force and mean reset force are then compared with respective target values loaded into a controller memory (not shown), and analyzed using known statistical process control methods. If corrective action is required, the controller is coupled to stepper motors 20, 22 (shown in FIGS. 1 and 2) for independent, real time adjustment of the applied reset and trip forces in form station 12 to correct deficiencies in the formation of the disks.

For example, if a given disk snaps too soon, i.e., at lesser force than desired, this indicates that the snap-disks are being stretched too much in form station 12 (shown in FIGS. 1–3), which can be cured by sending a signal to one or both of stepper motors 20, 22 (shown in FIGS. 1 and 2) to move the respective form adjust slide 92 (shown in FIGS. 2 and 3) of reset form punch 116 and/or trip form punch 130 (shown in FIG. 3) to reduce the distance traveled by reset form punch 116 and/or trip form punch 130 during formation of the snap-disks. Therefore, successive disks will be stretched to a lesser extent and exhibit a greater resilience. Similarly, stepper motors 20, 22 can be used to increase the distance traveled by reset form punch 116 and or and/or trip form punch 130 when a mean snap force is higher than desired. In this fashion, snap-disks can be formed within desired trip force and reset force tolerances.

Stepper motors 20, 22 could be controlled independently or identically. Identical control of both motors 20, 22 is sufficient in cases where the difference in reset formation force and trip formation force is relatively small, as the same adjustment of both formation forces will yield approximately the same increase or decrease in resultant actual snap forces. With larger differentials in applied reset and trip formation forces, however, independent feedback and control of both reset and trip sides of the snap-disks is necessary.

After passing through feedback station 16, the snap-disks are placed into one of three storage bins (not shown). An acceptable first pass bin collects snap-disks within specified tolerances. A discard bin collects unusable snap-disks that have been stretched too much and therefore snap too easily. A reform bin collects snap-disks that have not been stretched enough and that may be reformed in form station.

By using instantaneous feedback control, acceptable yield pass rates upon initial formation of snap-disks are dramatically improved. Pass rates of 90% or more may be realized, thereby significantly increasing manufacturing efficiency and reducing material costs by minimizing scrap. Using the fully automated process described, the labor burden may also be reduced. Thus, the costs of production of snap-disks are reduced.

While the invention has been described in terms of various specific embodiments, those skilled in the art will recognize that the invention can be practiced with modification within the spirit and scope of the claims.

What is claimed is:

1. A method for forming a plurality of bistable snap-disks having two alternative configurations from a plurality of double sided disk blanks, said method comprising:

stretching at least one side of each of the disks into plastic deformation with at least one of a reset form force and a trip form force, thereby forming at least one of a reset side and a trip side into the disk;

sequentially monitoring a peak force for snapping the at least one of a reset side and trip side of at least some of the disks after they are formed; and adjusting at least one of the reset form force and the reset trip force in response to the monitored peak force to change the required peak snap force of successively formed disks and bring successive disks within desired peak snap force tolerances.

2. A method in accordance with claim 1 wherein the step of stretching the disks comprises:

engaging a center of each disk with a probe; and moving the probe a specified distance.

3. A method in accordance with claim 1 wherein said method further comprises the step of exercising the at least one of a reset side and a trip side of each of the disks with at least one of a reset exercise force and trip exercise force.

4. A method in accordance with claim 1 wherein said step of monitoring the required peak force comprises:

applying a force to the at least one of a reset side and a trip side of a batch of disks until each disc snaps into the alternative configuration;

measuring the force as it is applied; and recording the peak snap force.

5. A method in accordance with claim 4 wherein said step of adjusting at least one of reset form force and trip form force comprises:

calculating a mean peak snap force for a specified number of disks;

comparing the mean peak snap force to desired values; and changing at least one of the reset form force and the trip form force to correct a deviation between desired values and calculated values.

6. A method in accordance with claim 5 wherein said step of changing the at least one of the reset form force and the trip form force comprises incrementally increasing or decreasing the at least one of the reset form force and the trip form force.

7. A method in accordance with claim 5 wherein the step of changing at least one of the reset form force and the trip form force comprises changing both reset form force and trip form force by an equal amount.

8. A method in accordance with claim 1 further comprising the step of sorting the disks in response to the monitored peak force.

9. A method in accordance with claim 1 wherein said steps of stretching, monitoring, and adjusting occur contemporaneously.

10. A method for forming a plurality of bistable snap-disks in a snap-disk form assembly, the assembly including a form station and a feedback station coupled to the form station, said method comprising the steps of:

forming reset and trip sides of snap-disks with the form station;

monitoring a peak snap force for at least one side of the disks with the feedback station; and adjusting in real time the operation of the form station in response to the monitoring of peak snap force to bring disks formed in the form station into compliance with predetermined peak snap force values.

11. A method in accordance with claim 10 wherein the feedback station includes a probe and a force transducer, said step of monitoring comprises:

applying a force to a snap-disk with the probe until the snap-disk snaps; and measuring a peak force causing the disk to snap with the force transducer.

12. A method in accordance with claim 1 wherein the feedback station further includes a controller having a memory, said step of monitoring further comprising the steps of:

storing a measured peak force value of each disk after it is formed;

calculating a mean peak force value for a specified number of disks with the controller; and analyzing the mean peak force value.

13. A method in accordance with claim 12 wherein the step of analyzing comprises comparing the calculated value to a desired value.

14. A method in accordance with claim 10 wherein the form station includes a reset form punch engaging a reset side of a disk and stretching the reset side of the disk for a reset distance to form the reset side of the disk and a trip form punch to engage a trip side of a disk and stretching the trip side a second distance to form the trip side of a snap-disk, said step of adjusting the operation of the form station comprising adjusting at least one of the first distance and the second distance.

15. A method in accordance with claim 10 wherein the assembly further includes an exercise station, said method further comprising the step of exercising the snap-disks with the exercise station.

16. A method in accordance with claim 10, the assembly further including at least one dial fixture having a pocket, the method further comprising the steps of:

loading a disk into the pocket;

loading the dial fixture into the form station; and indexing the dial fixture from the form station to the feedback station.

* * * * *

UNITED STATES PATENT AND TRADEMARK OFFICE

CERTIFICATE OF CORRECTION

PATENT NO. : 6,343,414 B1 
DATED : February 5, 2002
INVENTOR(S) : Donald E. Nice and Richard T. Kidwell It is certified that error appears in the above-identified patent and that said Letters Patent is hereby corrected as shown below:

Column 9,
Line 31, delete "claim 1" insert -- claim 11 --.

Signed and Sealed this

Ninth Day of September, 2003

JAMES E. ROGAN
*Director of the United States Patent and Trademark Office*